US009091088B2

(12) United States Patent
Djoboulian

(10) Patent No.: US 9,091,088 B2
(45) Date of Patent: Jul. 28, 2015

(54) STACKABLE FORM

(76) Inventor: Gregory Haig Anthony Djoboulian, Vaudreuil (CA)

( * ) Notice: Subject to any disclaimer, the term of this patent is extended or adjusted under 35 U.S.C. 154(b) by 0 days.

(21) Appl. No.: 13/489,429

(22) Filed: Jun. 5, 2012

(65) Prior Publication Data

US 2013/0069265 A1 Mar. 21, 2013

Related U.S. Application Data

(60) Provisional application No. 61/535,936, filed on Sep. 16, 2011.

(51) Int. Cl.
*E04G 11/06* (2006.01)
*E04G 11/22* (2006.01)

(52) U.S. Cl.
CPC ..... *E04G 11/06* (2013.01); *E04G 11/22* (2013.01)

(58) Field of Classification Search
CPC ..... E04G 11/06; E04G 11/22
USPC ..... 264/33
See application file for complete search history.

(56) References Cited

FOREIGN PATENT DOCUMENTS

CN 101817200 A * 9/2010
GB 166789 A * 7/1921

* cited by examiner

*Primary Examiner* — Alison Hindenlang

(57) ABSTRACT

An improved method and apparatus for making structures and forts out of snow or other types of formable material. The apparatus includes a collapsible and stackable form comprising a plurality of vertical wall members connected along adjacent vertical edges to form a geometric volume that include support openings along its wall members lower edges for receiving a support member, and further having an open top and bottom perimeter which allows the stackable form to be continuously filled, removed and stacked on top of previously formed block members thus allowing the user to create multiple tiered structures.

12 Claims, 13 Drawing Sheets

STACKABLE FORM

CROSS-REFERENCES TO RELATED APPLICATIONS

This application claims the benefit of U.S. provisional patent application No. 61/535,936 filed on Sep. 16, 2011 under the title: Stackable Form. Priority benefit is also claimed from Canadian application no. 2,753,374 filed on Sep. 19, 2011 under the title: Stackable Form.

This invention relates generally to building blocks and more specifically to a self supporting stackable material block form. The method and apparatus is used to facilitate and improve the creation of structures and shapes out of snow, sand and other formable building material.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

When building a material structure such as a snow fort or castle it is ideal that the process move forward quickly in order to maintain interest in the project. The easier it is to create and construct the more fun and time the user will have to enjoy it. Household containers have a narrow base and a wide top making stacking one block on top of another extremely difficult. In addition the material blocks are often too heavy for children to lift and stack to an adequate building height.

Container style material block makers that are currently on the market are much too small and take to much time to complete a decent structure. More importantly kids and adults are often exposed to dangerous situations when creating a snow shelter from a mound of snow, typically a hole is dug in the center of a mound of snow creating a void space to play in. The weight of the roof of the created structure is a safety hazard due to cave-ins. By using a stackable form to build vertical walls of snow the risk of cave-ins is virtually eliminated, in addition the stackable form users no longer have to drag, push or lift blocks of snow or other material, instead they can continuously create, in a top loading manner, their own blank canvas of the desired material block or combination of blocks to build, carve or mould to a desired shape or structure. By facilitating the material block making process the users are more inclined to participate, continue, complete and safely enjoy their projects. In reference to the secondary function of the invention where a plurality of stackable forms are used to be stacked on top of each other, the invention allows structures to be built safely and efficiently instead of using traditional building blocks or materials that have to be cut, nailed and screwed together such as lumber, wood planks and shingles when building structures such as a house, playhouse, shed or fort.

1. Field of the Invention

446/108, 164/349

2. Background Art

Traditionally, buckets and storage containers are used to form blocks of snow and sand, however tipping or stacking the containers to empty them results in damaged or broken material blocks. Using buckets to create sand castle is a frustrating experience for younger children as they cannot lift and tip them to effectively create a sand form. By using an open top and bottom form they can easily load and lift of the form leaving behind a intact shape. Furthermore multiple sizes and shapes of buckets are required to create a formable material castle like structure. The stackable form is collapsible and can be configured to multiple desired shapes due to the support openings which also allow the users to stack additional blocks on top of previously created blocks.

BRIEF SUMMARY OF THE INVENTION

The present invention is directed to two building systems both are founded on the same design principles. One is a system that allows users to create multiple tiers of material blocks without having to lift, flip and empty heavy containers of material such as snow and sand. In a preferred embodiment of a stackable form, a portable collapsible open ended top and bottom form is provided including a U-shaped bottom support member. The stackable form is opened and placed on a relatively flat snowy surface forming a geometric volume. The stackable form is filled with snow and compacted level to the upper edges of the vertical wall members. The user then pulls the stackable form up vertically using the carrying handles exposing a snow block. The support member is then placed on top of the stackable forms previously created block members top surface. The stackable form is then placed on top of the support member and secured in place by support openings on two opposing vertical wall members lower edges. The depth of the support openings permit the stackable forms lower edge to overlap on the previously formed block members surface in a downward direction which aligns and secures its position. Once the stackable form is re-filled with the desired material and compacted the stackable form is vertically removed using its carrying handle exposing a second newly created block member, the support member is then horizontally pulled out of the previously created block member, the process is continued as desired.

The other building system is when a series of stackable forms can be stacked on top of additional stackable forms with the use of multiple support members. In a preferred embodiment of a stackable form structure the stackable forms including upper and lower support openings on a plurality of the stackable forms vertical wall members upper and lower edges. A stackable form is placed on the ground, the support members are then placed in the upper support openings and a second stackable form is then placed on top of the support member and secured in place by the lower support openings of the second stackable forms lower edges. The depth of the upper and lower support openings, each generally one quarter of the vertical wall members' height permits the stackable forms joining perimeter edges to rest on top of each other securing, unifying and solidifying the structure.

DETAILED DESCRIPTION OF THE INVENTION

Figure 1:
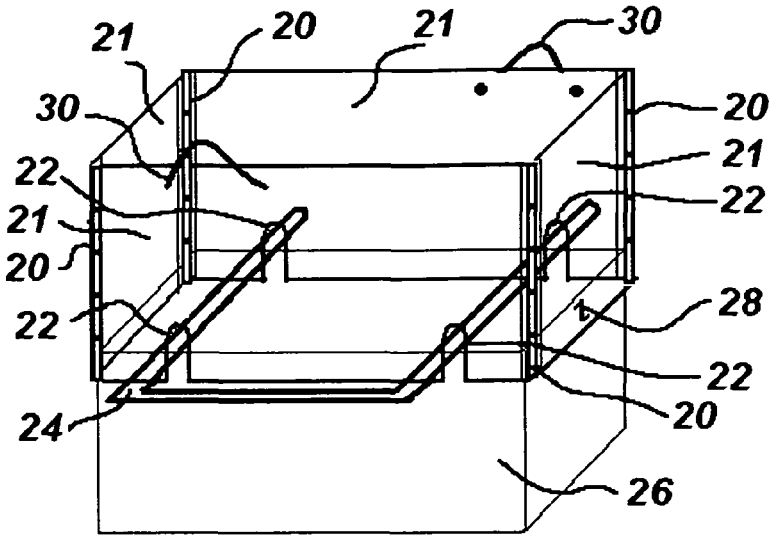
FIG. 1 represents a stackable form for receiving building material to create stackable shapes and structures. A plurality of vertical wall members 21 pivotally connected along adjacent vertical edges 20 form a geometric volume. Two of the vertical wall members include support openings 22 on their lower edge and in conjunction with a U-shaped support member 24 holds up the stackable form when placed on top of a previously created block member 26, the support openings creates a downward overlap 28 on a previously created block member. Carrying and lifting handle members 30 are positioned on the stackable forms upper edge on two of the vertical wall members.

The stackable forms can take any number of geometric shapes but is preferably configured as a rectangle as seen in the particularly advantageous embodiment of the invention illustrated in FIG. 1 comprised of four hinges 20, four vertical wall members 21 to form a stackable form open on its top and bottom perimeters. Two opposing vertical wall members of the stackable form include two support openings 22 along their lower horizontal edges. A U-shaped support member 24, used in conjunction with the support openings surpasses the stackable forms width thereby holding up the stackable form on top of its own previously created block member. The support openings 22 on the stackable forms lower horizontal edges are open at a sufficient vertical distance permitting the stackable forms bottom horizontal edges to exceed the support apparatus' lowest extremity creating an overhang when the stackable form is resting on top of the support member 28.

Figure 11:
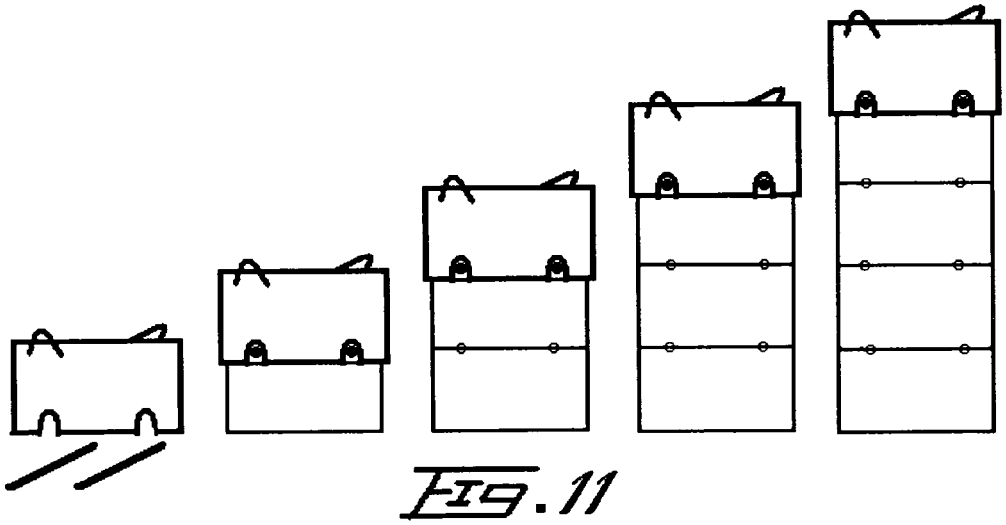
FIG. 11 illustrates the step by step block member stacking process using the stackable form in conjunction with a support member.
Figure 12:
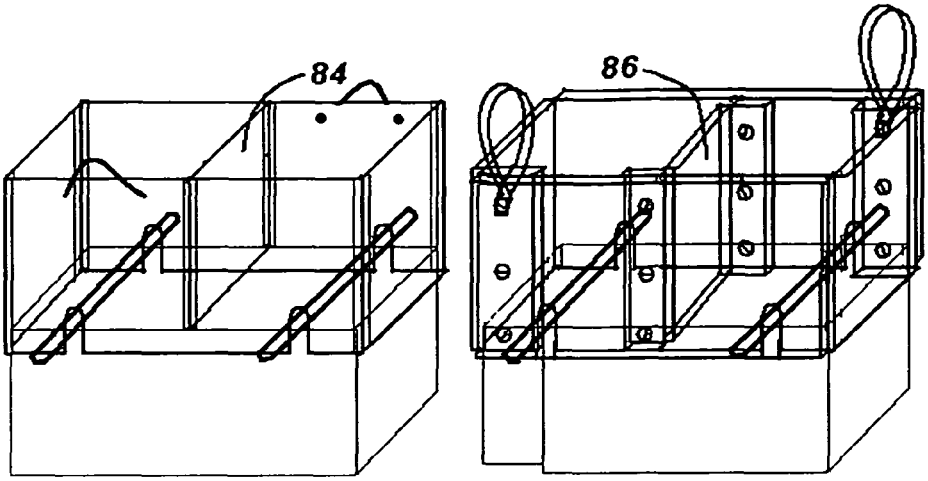
FIG. 12 represents an internal stackable form expansion reducer panel adapted to be coupled to two vertical wall members using an extruded plastic panel 84, a fluted corrugated plastic panel 86. The expansion reducer panel maintains the geometric volumes shape during the block member making process.

The stackable forms overhang surrounds the perimeter of the previously created block member ensuring the next block member is properly aligned as seen in FIG. 11. The overhang from the stackable form maintains the previously created block members shape when exposed to a downward pressure during the material filling process for the next block member. Two opposing vertical wall members of the stackable form include handles 30 to facilitate the vertical removal of the stackable form from the material packed into it.

Figure 2:
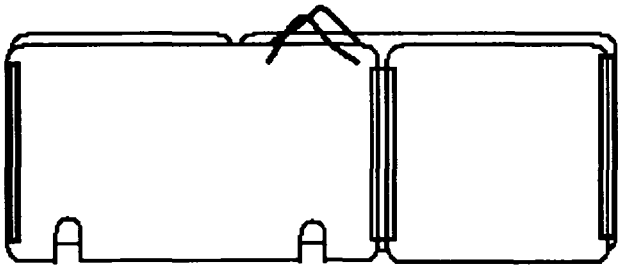
FIG. 2 illustrates FIG. 1 in a collapsed stackable form configuration.
Figure 3:
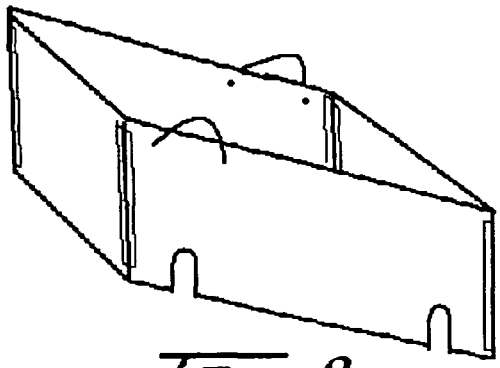
FIG. 3 represents the collapsible stackable form partially open forming an alternate geometric volume.
Figure 4:
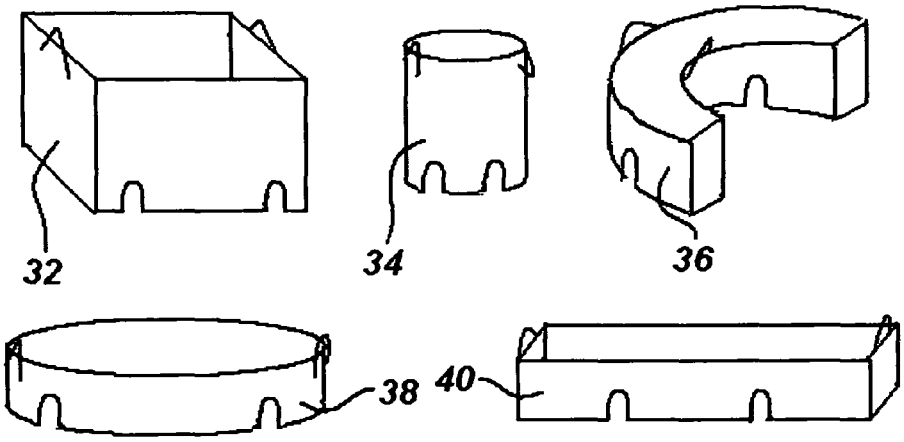
FIG. 4 represents examples of various moulded solitary stackable forms resulting in alternate geometric volume configurations, a square 32, a cylinder 34, a U-shape 36, a circle 38 and a rectangle 40.
Figure 5:
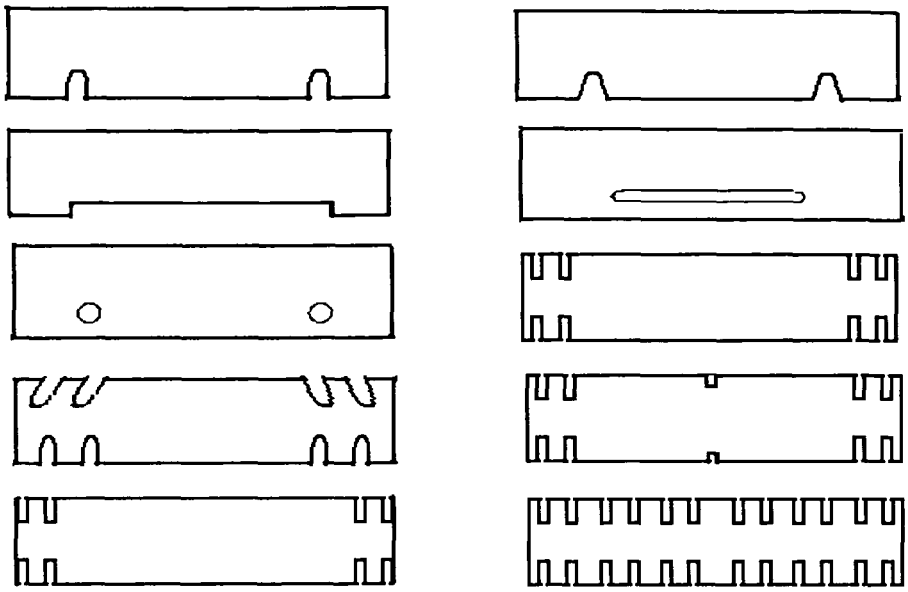
FIG. 5 illustrates various examples of a vertical wall member with alternate support openings.
Figure 6:
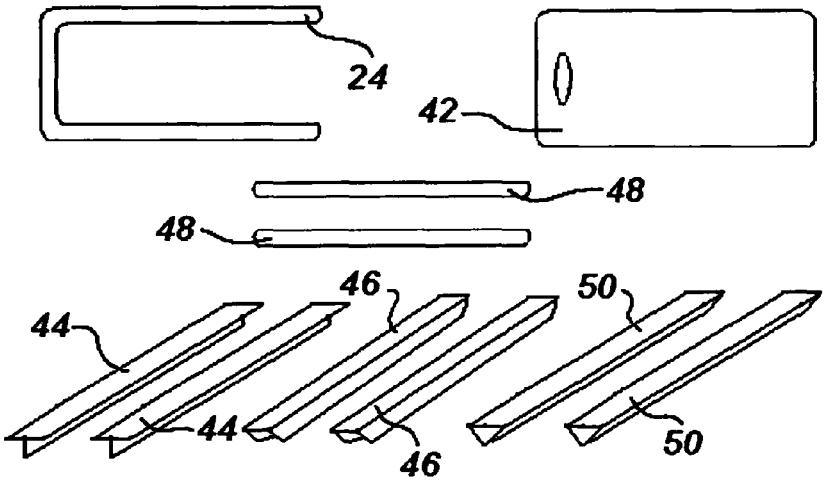
FIG. 6 represents examples of different support member cross-sectional shapes that include a U-shaped tube 24, a rectangle 42, a T-shape 44, a U-shaped channel 46, a round tube 48 and a triangular tube 50.
Figure 13:
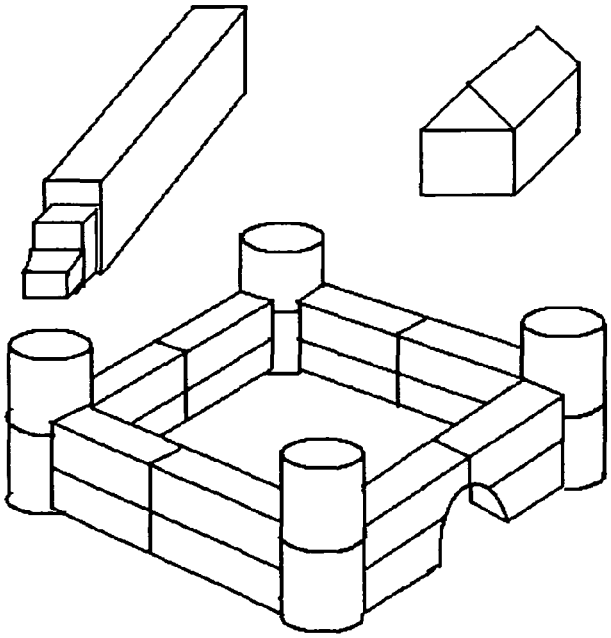
FIG. 13 illustrates several results of a combination of sand blocks created with the stackable form.

The handles facilitate the transportation of the stackable form when in its collapsed state as seen in FIG. 2. In a partially open result of the collapsed stackable form seen in FIG. 3 users can select the pivotal position of the stackable form to define a free space of greater or lesser width to produce variable block member thicknesses and shapes. When the material is packed into the stackable form an expansion reducer panel, coupled extruded plastic 84, pivotal fluted corrugated plastic 86 within the stackable forms opposing vertical wall members as seen in FIG. 13 prevents the stackable form from bowing due to any downward pressure. FIG. 6 illustrates various support member configurations when used in conjunction with various support opening configurations as seen in FIG. 5 on one vertical wall members of the stackable form.

Figure 7:
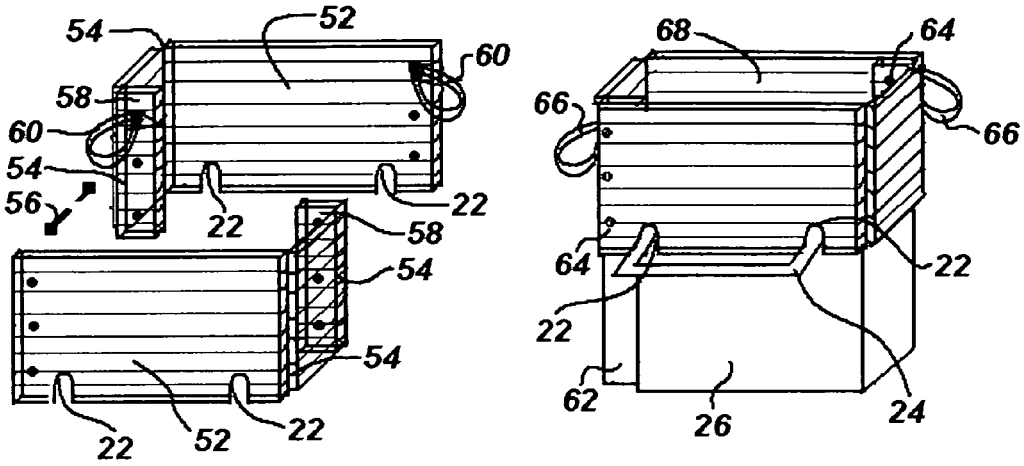
FIG. 7 represents an alternate embodiment of the invention, two vertical wall members made of fluted corrugated plastic sheets 52 are pivotally adapted by vertical slits 54 to form a geometric volume and coupled together using a fastening system such as Chicago screws 56 unassembled and 64 assembled, to form a stackable form 68. Two of the vertical wall members include support openings 22 at their lower edges. A U-shaped support member 24 is placed at the positioning mark 62 holds up the stackable form when placed upon a previously created block member 26. The inside fluted corrugated plastic flap 58 creates a vertical positioning mark 62 when the stackable form is lifted away and removed from a previously created block member 26. The fastening system such as Chicago screws 56 also secure the carrying/pulling handles 60 and are adapted to receive the fastening system such as Chicago screws on an un-assembled stackable form 60, and on an assembled stackable form 66.
Figure 8:
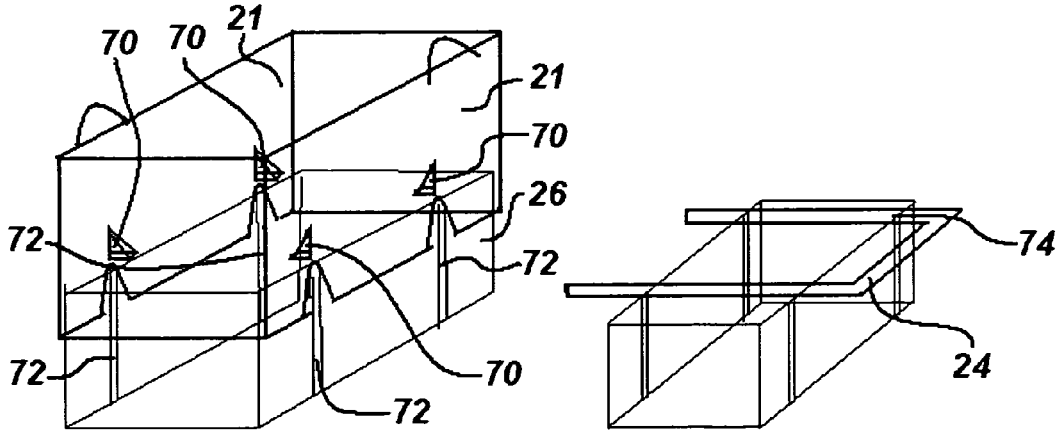
FIG. 8 represents an alternate support member positioning marker 70 on the inside of two opposing vertical wall members 21 which leaves a vertical mark 72 when the stackable form is lifted away and removed from a previously created block member 26. A U-shaped support member 24 is placed at the positioning mark 74.

FIG. 7 illustrates a particularly advantageous alternate embodiment of the invention, two vertical wall members made of fluted corrugated plastic sheets are vertically slit 54 are coupled together using a fastening system such as Chicago screws 56 to form a stackable form. The inside flap of the fluted corrugated sheet 58 creates a vertical groove 62 in a previously created block member 26. The grooves indicate the proper positioning for the support member 24. A fastening system such as Chicago screws through predrilled holes of the fluted corrugated plastic sheet 64 secure the carrying/pulling handles 66. FIG. 8 represents alternate positioning markers 70, groove vertical marks along the previously created block members' facade during the removal of the stackable form indicating proper positioning markers for the support members 24.

Figure 16:
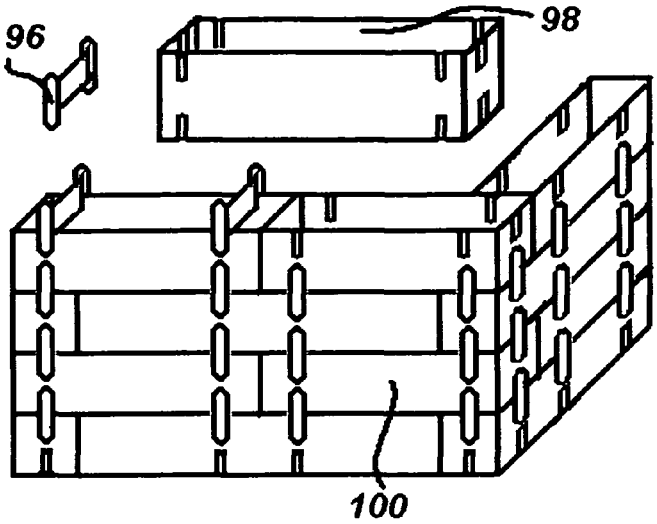
FIG. 16 represents an alternate embodiment of the invention whereby the support members 96, are generally half the height of the vertical wall members. A plurality of support openings on the upper and lower edges of the stackable form 98, generally one quarter of the stackable forms height are used to allow additional stackable forms to stack on top of each other using the support members 96 to form a stackable form structure 100.
Figure 18:
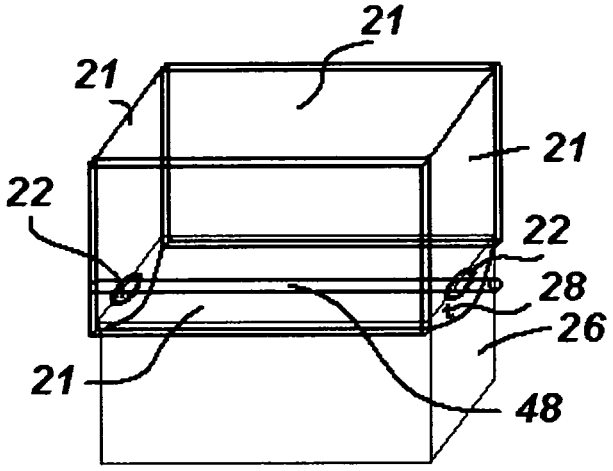
FIG. 18 represents a plurality of vertical wall members 21 connected along adjacent vertical edges to form a geometric volume with alternate support openings 22 on two of the vertical wall members lower edge and in conjunction with an elongated support member 48 holds up the stackable form when placed on top of a previously created block member 26, the support openings creates a downward overlap 28 on a previously created block member.
Figure 19:
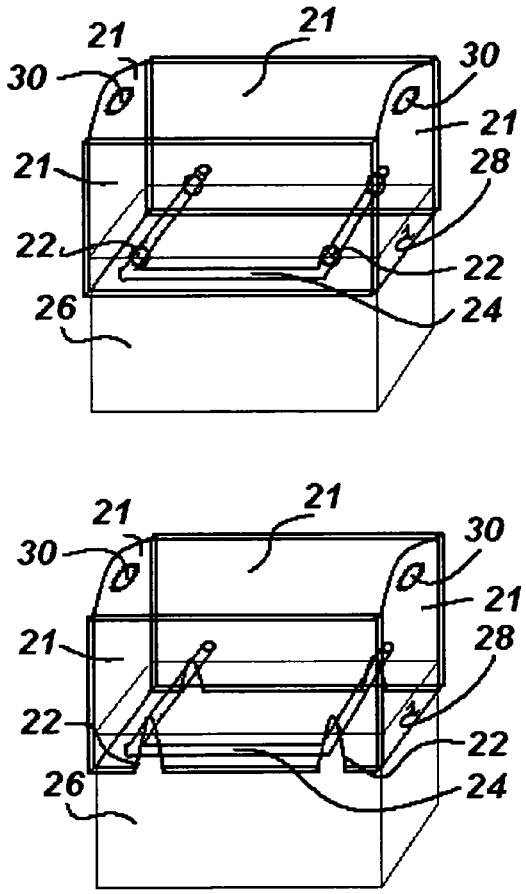
FIG. 19 represents addition embodiments of the invention, a plurality of vertical wall members 21 connected along adjacent vertical edges to form a geometric volume with support openings 22 on two of the vertical wall members lower edge and in conjunction with a U-shaped support member 24 holds up the stackable form when placed on top of a previously created block member 26, the support openings creates a downward overlap 28 on a previously created block member. Carrying and lifting handle members 30 are positioned on the stackable forms upper edge on two of the vertical wall members.
Figure 20:
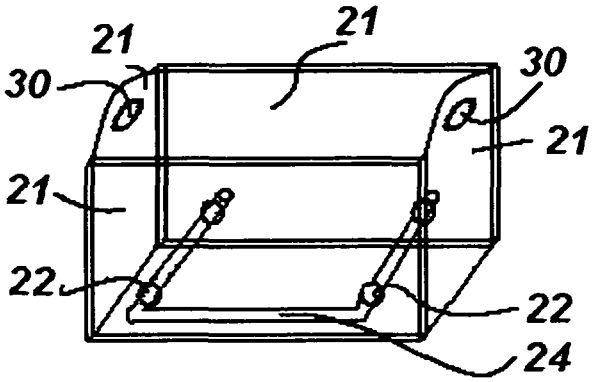
FIG. 20 represents an embodiment of the invention without a material block member, a plurality of vertical wall members 21 connected along adjacent vertical edges to form a geometric volume with support openings 22 on two of the vertical wall members lower edge and in conjunction with a U-shaped support member 24. Carrying and lifting handle members 30 are positioned on the stackable forms upper edge on two of the vertical wall members.
Figure 21:
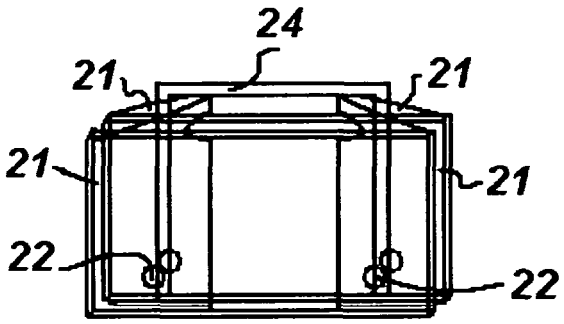
FIG. 21 illustrates FIG. 22 in a collapsed stackable form configuration, a plurality of vertical wall members 21 connected along adjacent vertical edges to form a geometric volume with support openings 22 on two of the vertical wall members lower edge and in conjunction with a U-shaped support member 24
Figure 22:
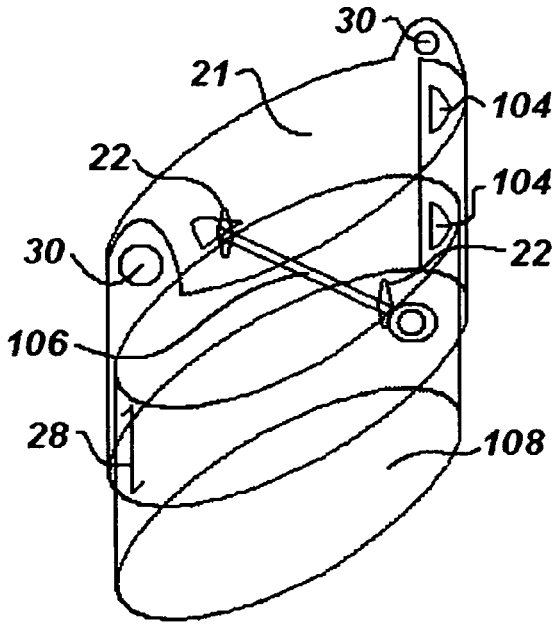
FIG. 22 represents an addition embodiments of the invention, a single vertical wall members 21 connected by tongue and grove slits and flaps 104 along adjacent vertical edges to form a geometric volume with support openings 22 on opposing sides of the vertical wall members lower edge and in conjunction with a sculpting tool expansion reducer support member 106 holds up the stackable form when placed on top of a previously created oval member 108, the support openings creates a downward overlap 28 on a previously created circular member. Carrying and lifting handle members 30 are positioned on the stackable forms upper edge on opposing sides of the vertical wall members.

An alternate configuration of a vertical wall members made of fluted corrugated plastic 90, seen in FIG. 16 is vertically slit 54 to pivotally shape a single panel stackable form. A releasable connector member 88 joins the connecting ends 92 of the fluted corrugated plastic sheet forming a rectangular stackable form 94. FIG. 18 illustrates an additional alternate configuration of a fluted corrugated plastic 94, vertically notched 102 to pivotally shape a single panel stackable form with lower support openings at the lower edges 22. Chicago screws connect the joining ends 64. By notching the corrugated plastic the form can be folded and assembled inwardly hiding the pivotal seems.

Figure 9:
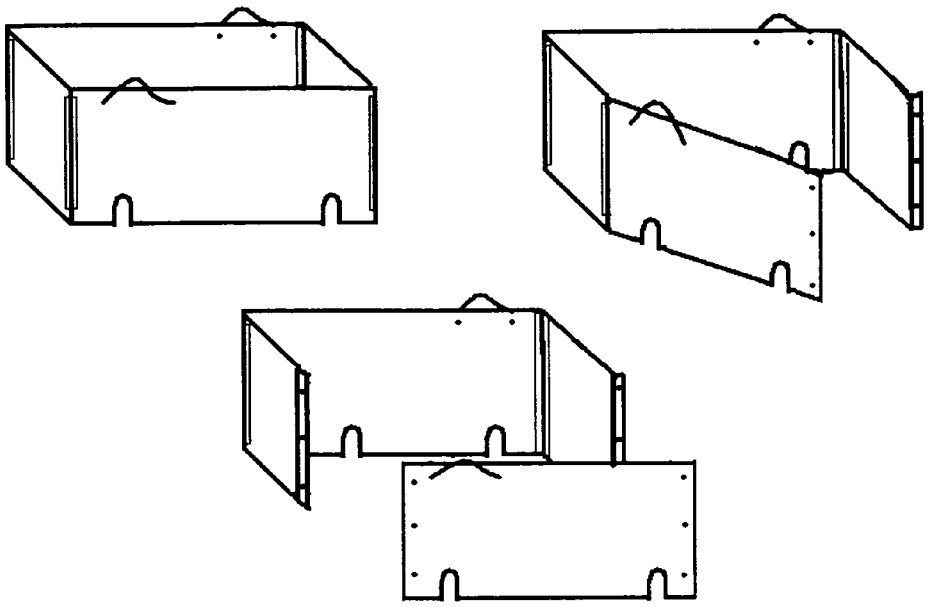
FIG. 9 represents examples of plurality of vertical wall members pivotally and releasably connected along adjacent vertical edges connected by connector members that include hinges, scoring, Velcro, button snaps, to form a stackable form.
Figure 10:
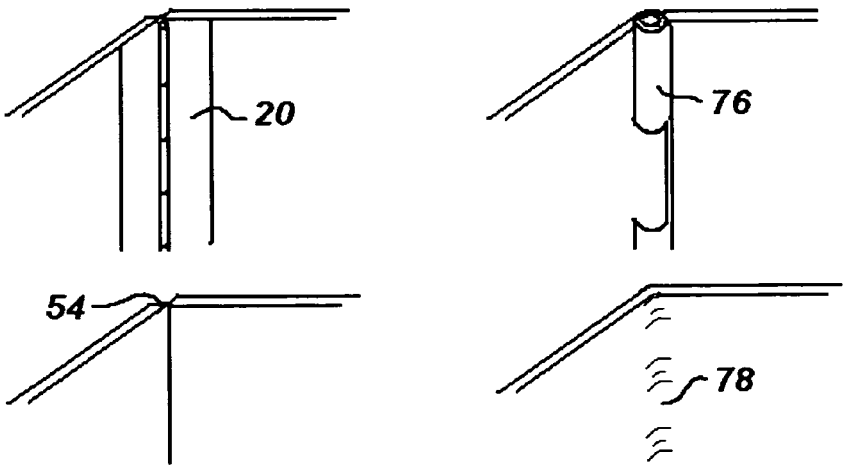
FIG. 10 represents connection methods on the vertical wall members adjacent edges. Pivotal wall members include fastened hinges 20, built in hinges 76, creasing, scoring and slit 54. Fixed wall members include a solitary moulded unit 78.
Figure 14:
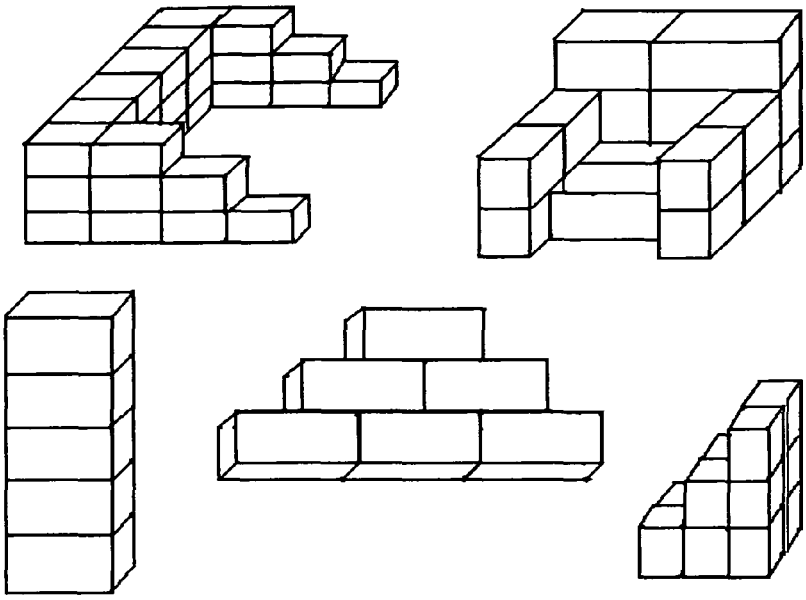
FIG. 14 illustrates several results of a combination of snow blocks created with the stackable form.
Figure 15:
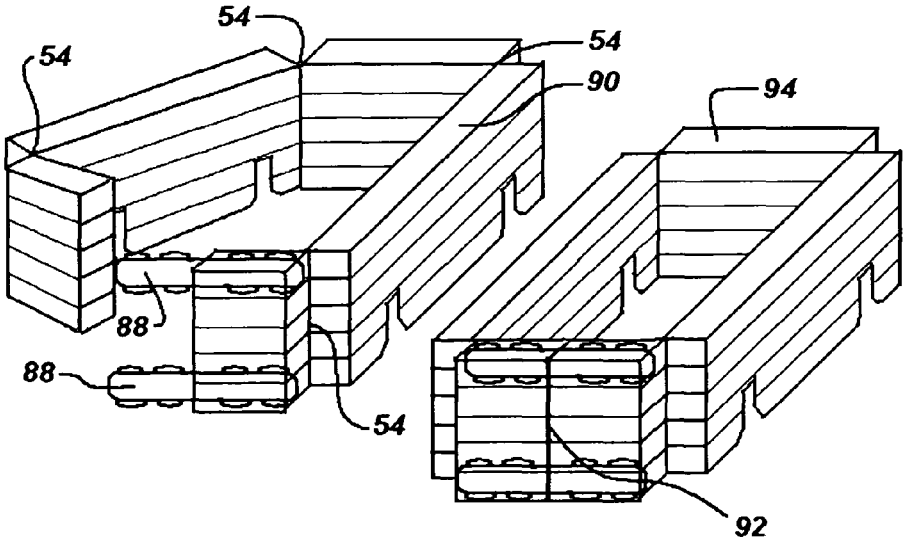
FIG. 15 represents a single vertical wall member made of fluted corrugated plastic sheet 90 vertically slit 54 to pivotally form a single panel stackable form 94. A releasable connector member 88 joins the connecting ends 92 of the fluted corrugated plastic sheet.

Alternate sidewall connection configurations of the stackable form are seen in FIG. 9 and alternate sidewall connection methods of the stackable form are seen in FIG. 10. FIG. 11 illustrates the step by step material block stacking process. The stackable form is placed on a relatively flat surface in the users' desired configuration and filled with a formable material such as snow. Once the stackable form is filled with the material and compacted level to the upper open edge of the stackable form the carrying handles are used to vertically remove the stackable form from a newly shaped block member creating a base block member. The stackable form is then placed on top of the newly created base block member and over the support member allowing the stackable forms sidewalls support openings to hold up the stackable form creating the mould for the second block member. The process of filling, compacting and removing the stackable form is repeated. The support member is then horizontally pulled out of the base block member and placed on top of the newly shaped second block member and re-positioned on top of it to receive the stackable forms support openings creating a third tier mould, the process continues as desired to create snow structures illustrated in FIG. 14 and sand structures illustrated in FIG. 15.

Figure 17:
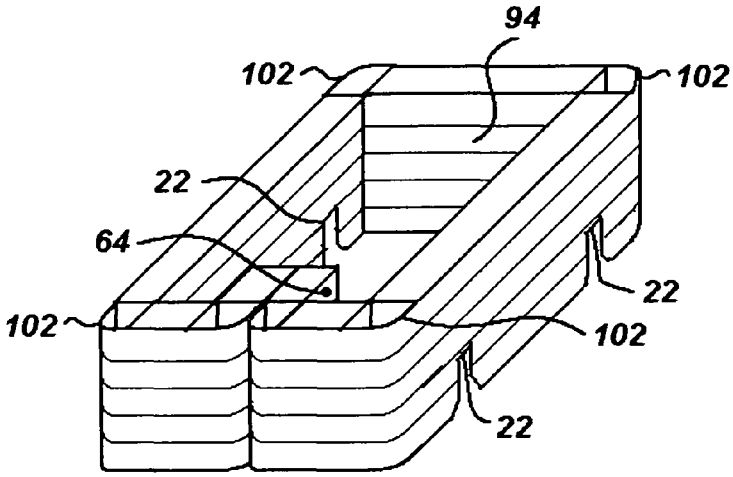
FIG. 17 represents a rectangular stackable form made of fluted corrugated plastic 94, vertically notched 102 to pivotally shape a single panel stackable form with lower support openings at the lower edges 22. Chicago screws connect the joining ends 64. By notching the corrugated plastic the form can be folded and assembled inwardly hiding the pivotal seems.

FIG. 17 represents an alternate embodiment of the invention whereby the support members 96 are generally half the height of the vertical wall members. A plurality of support openings on the upper and lower edges of a stackable form 98, generally one quarter of the stackable forms height are used to allow additional stackable forms to interlock on top of the support members to form a stackable form structure 100.

While the present application has been shown and described with particular references to a number of preferred embodiments thereof, it should be noted that various other changes or modifications may be made without departing from the scope of the present invention.

The embodiments of the invention in which an exclusive property or privilege is claimed are defined as follows:

1. A stackable form for receiving building material therein and creating stackable shapes and structures, said stackable form comprising:

one or more vertical wall members connected along adjacent vertical edges to form a geometric volume with a plurality sides;

a plurality of support openings formed in at least two of said sides;

and at least one horizontally removable support member adapted to fit within one or more of the plurality of openings in at least two of said sides, wherein said at least one horizontally removable support member is adapted to sit upon a surface to hold up said vertical wall members thereon, such that said geometric volume is adapted to be filled with a building material, wherein said building material surrounds said at least one horizontally removable support member within said geometric volume such that said at least one horizontally removable support member can be horizontally removed from said building material and geometric volume such that said geometric volume is then lifted away from said building material thereby leaving said building material behind in the shape of said geometric volume.

2. The stackable form of claim 1, wherein said one or more vertical wall members are pivotally connected along adjacent vertical edges using a pivoting mechanism that is chosen from a list of pivoting mechanisms that includes hinges, creases, and scoring.

3. The stackable form of claim 1, further including at least one handle member at an upper edge of at least one of said vertical wall members, and adapted to be used to lift said stackable form away from said building material.

4. The stackable form of claim 1, wherein said geometric volume forms a shape that has a cross-sectional shape that is chosen from a list of cross-sectional shapes that includes a square, a rectangle, a cylinder, a circle, an oval, and a U-shape.

5. The stackable form of claim 1, wherein said plurality of support opening are formed as a space having a shape chosen from a list of shapes that include a square, a rectangle, an oval, a circle, and a curve.

6. The stackable form of claim 1, wherein said at least one horizontally removable support member has a cross-sectional shape chosen from a list of cross-sectional shapes that includes a circle, a square, a rectangle, a triangle, a cylinder, a U-shape, and a T-shape.

7. The stackable form of claim 1, further comprising an expansion reducer panel adapted to be placed within said geometric volume and attached to at least one of said one or more vertical wall members, and adapted to maintain the geometric volume to which building material is supplied.

8. The stackable form of claim 1, wherein said at least one horizontally removable support member is formed as a U-shaped member, wherein each side of said U-shape is adapted to fit within a respective support opening of the plurality of support openings in said at least two sides.

9. The stackable form of claim 1, wherein said wall members are formed from a material chosen from a list of materials that includes cardboard, plastic, corrugated plastic, and metal.

10. The stackable form of claim 1, wherein at least one of said one or more wall members is releasably connected to itself by a connector member that is chosen from a list of connector members that includes latches, hook and loop fasteners, tongue and grove and button snaps.

11. A method of making shapes and structures out of formable building materials, comprising the steps of:

a) providing a stackable form comprising one or more vertical wall members connected along adjacent vertical edges to form a geometric volume with a plurality of sides; a plurality of support opening formed in at least two of said sides; and at least one horizontally removable support member adapted to fit within one ore more of the plurality of support openings in at least two of said sides, wherein said at least one horizontally removable support member is adapted to sit upon a surface to hold up said vertical wall members thereon, such that said geometric volume is adapted to be filled with a building material, wherein said building material surrounds said at least one horizontally removable support member within said geometric volume such that said at least one horizontally removable support member can be horizontally removed from said building material and geometric volume such that said geometric volume is then lifted away from said building material thereby leaving said building material behind in the shape of said geometric volume b) forming said block from in the geometric shape with the geometric volume desired;

c) placing said stackable form on a surface in a location desired;

d) filling said stackable form with the building material chose;

e) compacting said building material to the density desired, and forming a block;

f) lifting said stackable form up and away from said block.

12. The method of making shapes and structures of claim 11, further including the steps of:

g) placing said at least one horizontally removable support member of said stackable form on a top surface of the previous block;

h) placing said one ore more wall members upon said at least one horizontally removable support member, wherein said at least one horizontally removable support member engages one or more respective support openings of the plurality of support openings in at least two of the sides of said stackable form;

i) repeating steps d through h as many times as desired and forming a stack;

j) placing said stackable form on a surface in a location next to the previous stack;

k) repeating steps d through h as many times as desired and forming a stack next to the previous stack;

l) repeating steps j through k as many times as desired and forming a wall.

* * * * *